United States Patent [19]

Napier et al.

[11] Patent Number: 4,742,653

[45] Date of Patent: May 10, 1988

[54] COLLAPSIBLE STRUCTURES

[76] Inventors: Valda C. Napier; Donald S. Napier, both of Surrey Hills, Australia

[21] Appl. No.: 903,380

[22] Filed: Sep. 3, 1986

[30] Foreign Application Priority Data

Sep. 3, 1985 [AU] Australia ..... PH 2265/85

[51] Int. Cl.[4] ..... E04B 1/346

[52] U.S. Cl. ..... 52/66; 52/68; 52/69

[58] Field of Search ..... 52/66, 69, 68, 71, 64

[56] References Cited

U.S. PATENT DOCUMENTS 2,712,677 7/1955 Hyde ..... 52/66
3,460,297 8/1969 Fritz ..... 52/68 X
3,849,952 11/1974 Hanaoka ..... 52/69 X
3,992,828 11/1976 Ohe ..... 52/69
4,027,912 6/1977 Pacca ..... 52/64 X

FOREIGN PATENT DOCUMENTS 690823 7/1964 Canada ..... 52/64

*Primary Examiner*—Carl D. Friedman
*Assistant Examiner*—Creighton Smith
*Attorney, Agent, or Firm*—Foley & Lardner, Schwartz, Jeffery, Schwaab, Mack, Blumenthal & Evans

[57] ABSTRACT

A collapsible structure for use as temporary accommodation is in modular form, with a base upon which fold the walls and roof of the structure. The roof is hinged to one side wall and supported by the opposite side wall during erection of the structure, erection being possible by one man.

6 Claims, 2 Drawing Sheets

COLLAPSIBLE STRUCTURES

The present invention relates to collapsible structures particularly suitable upon erection as temporary working and/or storage buidlings, site offices and accommodation, shipping containers and other modular units.

The object of the present invention is to provide a structure which is readily erected at a required site, yet readily collapsed to flat for easy transport and storage when not required.

Accordingly, the present invention provides a structure comprising a base adapted to be located at a desired site, at least two opposite side walls and a roof supported by said two opposite side walls, the side walls being pivoted on pins supported at a distance above the base so that there is a gap between the base and the pin of a height sufficient to allow the walls and roof, if appropriate, to be folded down to lie flat against the base or another wall, the roof being hinged to the top of one of said opposite side walls so that it lies flat against that side wall during storage and the initial stage of erection, but is adapted to swing upwardly of said one side wall to hook onto said other side wall.

Although it is preferred to provide another pair of side walls to enable the structure to comprise an enclosed space having four walls and a roof, said another pair of side walls also being pivoted to the base by pins supported at a distance above the base, if desired, one or both side walls may be added to the structure separately. If the four walls are all provided, all being pivoted on pins above the base, a door opening or an outwardly opening door must be provided on at least one of the wall panels to enable access to an upper or side edge of the final wall panel to be erected, so that a lifting point is available.

The pivot pin is preferably housed in a hole cut into an upright welded to the base, said upright comprising a square tube, angle iron or U shaped section, with holes or slots at appropriate heights so that the respective walls can pivot about the pins and holes with sufficient clearance for the walls to fold flat against the base and other walls.

When used for temporary accommodation, the wall panels may be formed from metal clad polystyrene panels, preferably with a metal framework finishing the edges, and if necessary, holding two or more panels together. Alternatively, the pivot pin may extend through one or more panels to clamp them together. With larger structures, which would normally be difficult for one man to lift, a torsion bar may be used as a spring assisted pivot pin extending through the panel, the torsion providing sufficient initial momentum to allow one man to lift the wall.

In order that it is possible to stand in the structure, it is preferred that the base be at least 2.4 m wide (equal to a minimum height) and not more than 3.0 m, which corresponds to the maximum allowable width capable of being carried by road. The length of the base can be as long as desired, dependent on the length of the truck or trailer carrying it. In order to increase the width of the base, it is possible to place two structures together, eliminating adjacent walls and joining the roofs, possibly with a hollow cap member, electric wiring being included in the hollow to provide for lighting and power.

But in order that the invention may be more clearly understood, reference will now be made to the accompanying drawings, wherein.

Figure 1:
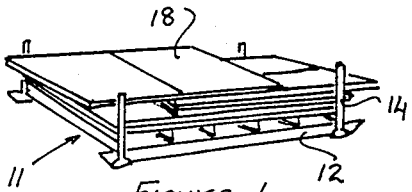
FIG. 1 shows a structure in its dismantled form, ready for erection, storage or transport.
Figure 2:
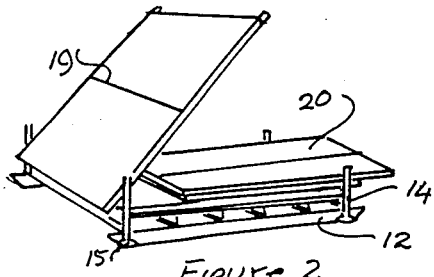
FIGS. 2 to 7 show the various stages in erection.
Figure 3:
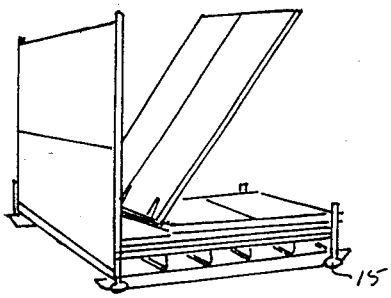
Figure 4:
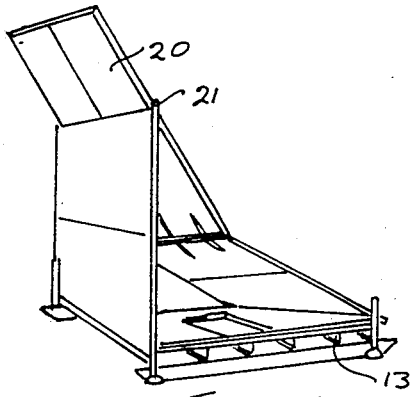
Figure 5:
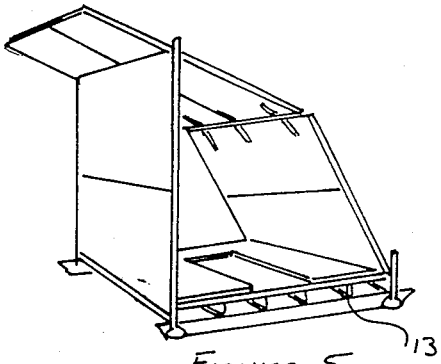
Figure 6:
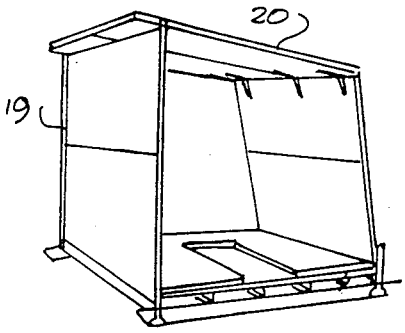
Figure 7:
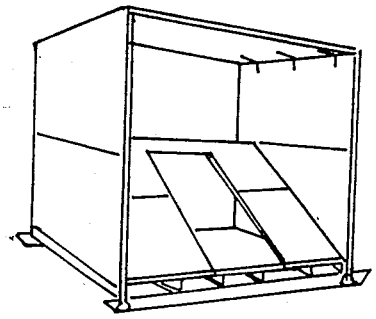

A steel framed base 11, formed of two parallel C beams 12 held together by a number of C beam cross members 13, has uprights 14 at each of its four corners, each upright 14 being a square tube welded to the base 11 and having feet 15 in the form of caps or shoes to enable stacking of one structure on top of another during transport and/or storage. One or a number of holes 16 are provided in the uprights 14 to accommodate pins 17 to lock the walls in position upon erection, the walls being pivoted on further pins in the uprights to enable pivotal raising from the flat transport position to the erect, ready to use position.

Wall members or panels 18 comprise panels of metal clad polystyrene. As the normal supply of such panels is in 1200 mm widths, at least two are united together in a metal frame 19. The pivotal pins are placed in the lower portion of the side edges of panels 18, at a variable height such that there is sufficient gap between the pin height and the base to allow each wall panel 18 to fold flat against the base and other wall panels.

Figure 8:
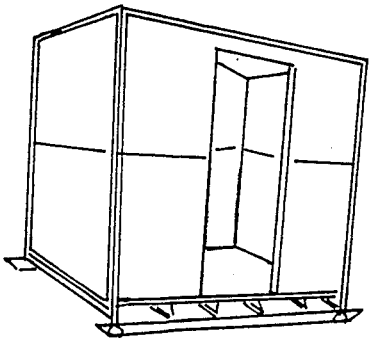
FIG. 8 shows the erected structure.
Figure 9:
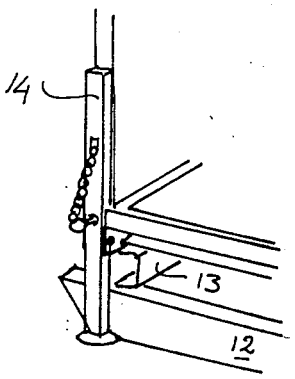
FIG. 9 is a close-up of one corner of the structure.

The roof member 20 is also advantageously a metal clad polystyrene panel, and is hinged to the top of one of the side walls by hinges to enable it to be lifted upwardly from the wall to rest on rollers 21 on top of the opposite side wall. On further movement of the hinged side wall, the rollers 21 act to guide the roof, with minimum friction, so that it pivots about the hinges on the side wall, the hinges allowing the roof to turn through 270°, and balances on the top of the other side wall as the hinged side wall is erected. The roof member 20 may be dimensioned so that it provides an overhang or eaves, and also, in conjunction with the side walls, so that it slopes from one wall to the other. Alternatively, as shown in FIG. 8, the roof member 20 sits flat on the tops of the four side walls 18 without any overhang or slope.

It will be apparent that the roof member, during transport and storage, lies flat against the wall to which it is hinged and the pivot pin for that wall is lower than the pivot pin for the opposite wall.

When the structure is provided with four side walls, care must be taken to ensure that the order in which the walls are laid flat against the base for transport and storage, so that upon erection, first one end wall is erected then the other end wall to which is hinged the roof, followed by one side wall, at least one of these walls, and preferably the next to last to be erected, being provided with a door opening or and outwardly opening door so that the final wall member may be lifted, access being gained to an edge, preferably the top edge, thereof for handling.

Dependent on the final use of the structure, the panels and/or the walls can be modified as required, possibly with the provision of windows or clear panels. If the structure is to be used as a container, it will probably be desirable to have at least one end wall hingeable about its adjacent wall to enable access to the interior of the container by a fork lift. The base of the structure in such a case would also have the provision to enable it to be carried by a fork lift, while, as the main load bearing capacity would be on the four walls, the roof need not be reinforced to the same extent.

When the structure is to be used as a site office on a building block, it is delivered to the site in its flat, as stored condition. At the site, it can be placed at the desired location and quickly erected, even by one man. Erection is merely a matter of swinging the panels upwardly, the roof panel being hooked to the opposite side wall to support the roof and stabilise the structure. Although light and easy to handle, it provides a cosy, insulated structure which is weatherproof and can be locked against vandals. When not in use, it can be quickly dismantled, carried off and stored in minimum space. The collapsible nature of the structure also enables it to be slid along a site in cases where overhanging trees or muddy ground prohibit access by truck.

Due to its lightness and compact storage size, it is possible to transport a number of these structures at one time, the feet 15 on one set of uprights 14 enabling positive stacking, thereby saving transport costs. Whereas only four 10' side assembled units can be transported on a 40' long semi-trailer tray, up to twenty-four of the units of the present invention can be stacked, in four stacks each six high, on the same semi-trailer tray. Further the compact size assists in avoiding problems encountered with low bridges and power lines during transport.

Thus it will be seen that the present invention provides a structure which is easy to handle, readily erected and dismantled, transported and stored, and yet which provides the user with the warmth and cosiness of known structures, and security against vandals.

What is claimed is:

1. A collapsible, transportable structure comprising a base having four corners and adapted to be located at a desired site, uprights provided at each of the four corners of the base, said uprights being formed with openings above said base, at least two opposite side walls and a roof supported by said side walls, the side walls being pivoted on pins engageable in said openings at a height above the base sufficient to allow each respective wall or roof to fold down to lie flat against the base and other walls, the roof being hinged to the top of one of said opposite side walls so that it lies flat against that side wall during storage and the initial stages of erection, but is adapted to swing upwardly of said one side wall to rest on said other side wall.

2. A structure as claimed in claim 1 wherein a pair of rollers are provided on the top of said other side wall, and said rollers guide and balance the roof during erection.

3. A structure as claimed in claim 1 wherein another pair of side walls are provided to enable the structure to comprise an enclosed space having four walls and a roof, said another pair of side walls also being pivoted on variable height pins above the base, and at least one wall other than the final wall to be erected, having a door opening or an outwardly opening door to enable access to an upper or side edge of the final wall to be erected.

4. A structure as claimed in claim 1 wherein there is provided one or two other side walls which are added to the structure separately.

5. A structure as claimed in claim 1 wherein the walls are formed from metal clad polystyrene panels with a metal framework finishing the edges.

6. A structure as claimed in claim 1 wherein a torsion bar extends through the walls and acts as the pivot pin at either edge thereof, said torsion bar assisting in the initial lifting stages of the walls.

* * * * *